United States Patent [19]

Duke et al.

[11] 4,306,626

[45] Dec. 22, 1981

[54] HYDRAULIC EARTH BORING MACHINE

[76] Inventors: John W. Duke, 160 Shilds Rd.; John A. Duke, 110 Springview Dr., both of Stockbridge, Ga. 30281

[21] Appl. No.: 151,865

[22] Filed: May 21, 1980

[51] Int. Cl.[3] ..... E21C 5/10; E21C 9/00

[52] U.S. Cl. ..... 173/35; 173/37; 173/149; 173/150; 173/156; 175/53

[58] Field of Search ..... 173/32, 33, 34, 35, 173/37, 44, 149, 150, 152, 156; 175/53

[56] References Cited

U.S. PATENT DOCUMENTS

| | | | |
|---|---|---|---|
| 1,210,187 | 12/1916 | Marquiss . | |
| 1,241,327 | 9/1917 | Becker | 173/37 X |
| 1,310,274 | 7/1919 | Branning | 173/43 |
| 2,174,415 | 9/1939 | Curtis | 173/37 X |
| 2,192,909 | 3/1940 | Hoffar | 173/149 |
| 2,310,960 | 2/1943 | Johansen | 173/149 X |
| 2,517,494 | 8/1950 | Kiss et al. | 173/31 X |
| 2,519,680 | 8/1950 | Macumber . | |
| 2,637,527 | 5/1953 | Andrews, Jr. | 173/152 X |
| 2,718,804 | 9/1955 | Dannheim . | |
| 2,823,898 | 2/1958 | Bankston . | |
| 2,969,121 | 1/1961 | Wallace | 173/152 X |
| 3,111,177 | 11/1963 | Osgood | 173/44 X |
| 3,160,074 | 12/1964 | Leander et al. | 173/152 X |
| 3,431,988 | 3/1969 | Bodine . | |
| 3,451,491 | 6/1969 | Clelland . | |
| 3,651,872 | 3/1972 | Smith et al. . | |

FOREIGN PATENT DOCUMENTS

| | | | |
|---|---|---|---|
| 248087 | 6/1912 | Fed. Rep. of Germany | 173/32 |
| 1641 | of 1911 | United Kingdom | 173/32 |

*Primary Examiner*—Wm. Carter Reynolds
*Attorney, Agent, or Firm*—Bradford E. Kile

[57] ABSTRACT

A hydraulic earth boring machine for forming conduit passageways beneath established surfaces such as roadways, walkways, or the like. The boring machine includes a hydraulic cylinder having an open axial passageway for receiving a boring shaft. A drive cylinder surrounds the boring shaft and is driven by the hydraulic cylinder. A gripping assembly is mounted upon a trailing end of the drive cylinder and selectively couples the drive cylinder to the boring shaft. An elevating and vertical aiming assembly is mounted upon the hydraulic cylinder for facilely providing positioning of the boring machine, in situ, within an earth trench. In addition, an axial bracing and horizontal angling assembly is mounted upon the cylinder for mounting the boring machine within the trench adjacent an established surface.

22 Claims, 16 Drawing Figures

FIG. 9
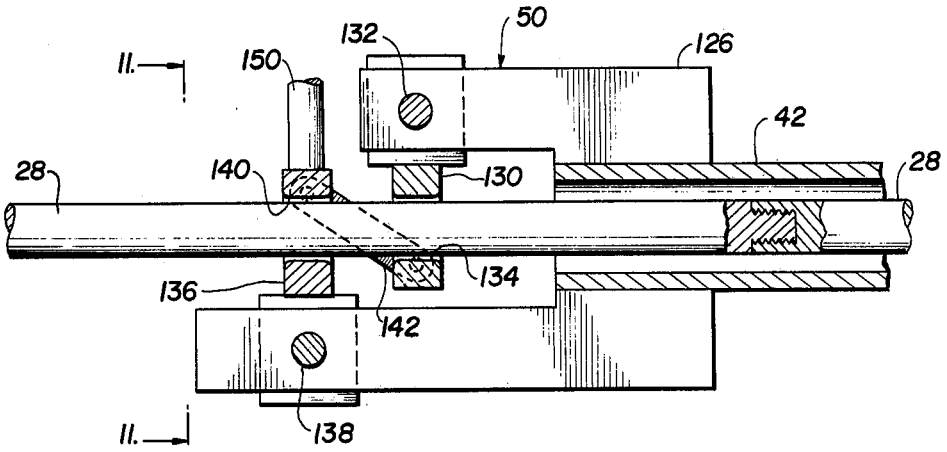
FIG. 10
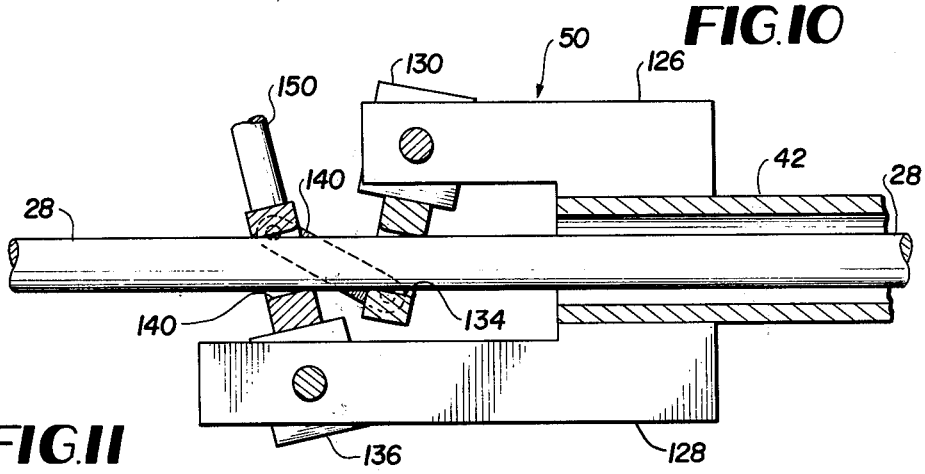
FIG. 11
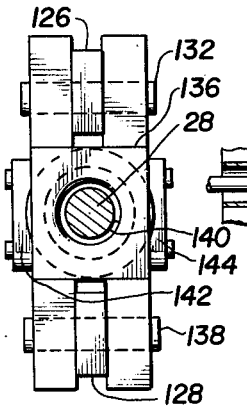
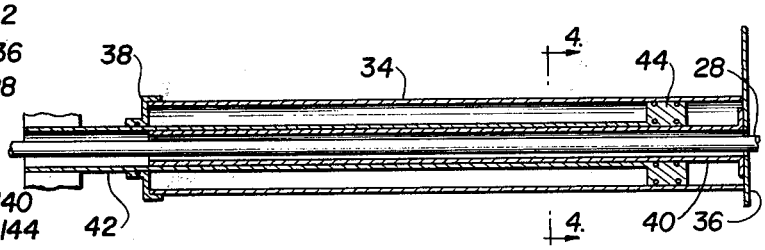
FIG. 3

FIG. 12
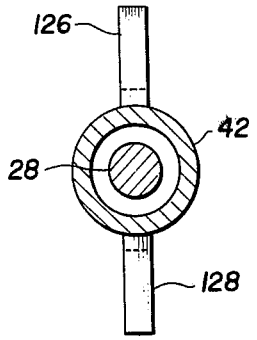
FIG. 8
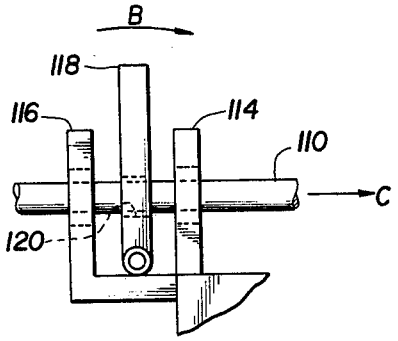
FIG. 6
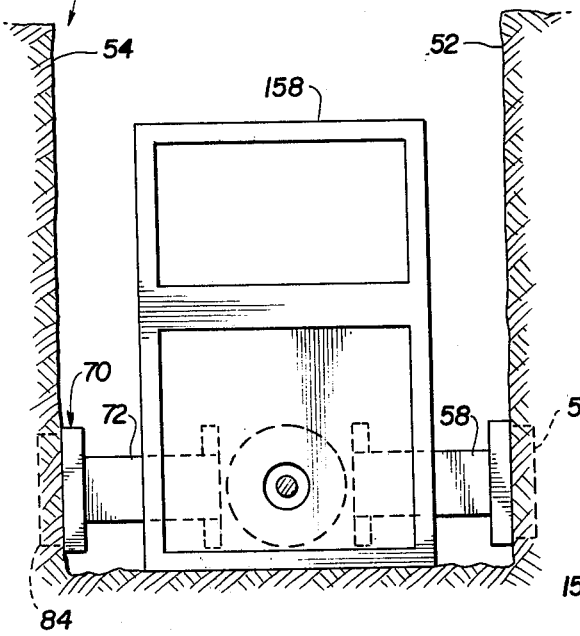
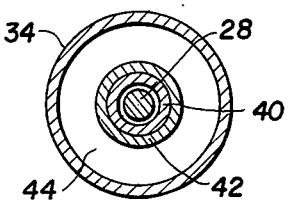
FIG. 4
FIG. 13
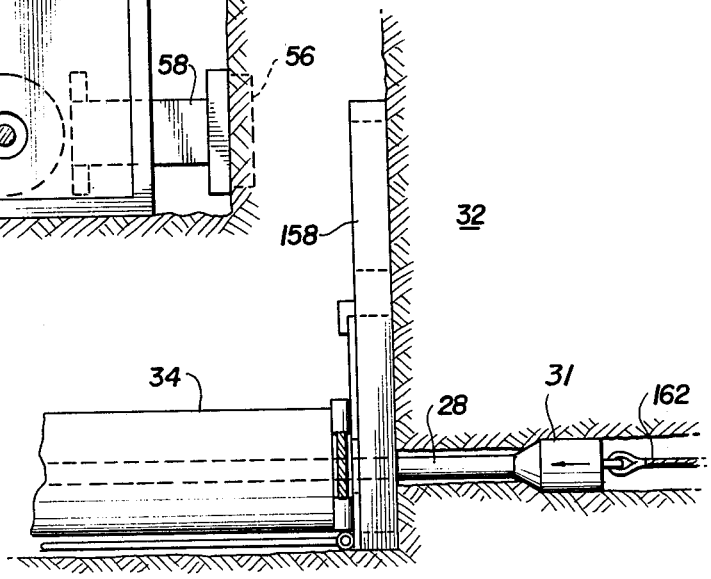

HYDRAULIC EARTH BORING MACHINE

BACKGROUND OF THE INVENTION

This invention relates to an earth boring machine. More specifically, this invention relates to a hydraulic earth boring machine operable to form generally horizontal passageways for conduits, cables, etc. beneath an established surface such as a roadway or the like without disturbing the roadway surface.

Underground conduits and the like are frequently placed by digging a trench to a desired depth laying, a continuous or articulated conduit within the trench, and then backfilling the trench. In some situations, however, it may be undesirable to utilize conventional pipe laying techniques. In this connection, it can be highly disruptive to traffic patterns to trench across an established roadway. Moreover, after conduit installation is completed, it is necessary to rebuild the roadway surface. This repaired strip is frequently subject to settling and/or wear damage that can create a potential traffic hazard. Further, in areas of high intensity piping, such as a chemical processing plant or the like, short run elevations in ground surfaces make piping installation by conventional trenching techniques difficult and burdensome.

In the above and other instances, it would be highly desirable to be able to form generally horizontal passageways beneath an established surface without forming a convention vertical trench.

In this connection, a number of machines have been at least theorized to provide generally horizontal earth passages for relatively short distances. Previously known horizontal boring of trenching machines are first mounted within an excavated area or trench adjacent a roadway or the like. A relatively small rod is then driven by the machine to pierce beneath the roadway to an excavated area on the opposite side. An enlarged head is then fitted onto the piercing rod and the rod is drawn back through the bore to increase the passageway to a size suitable to receive an underground conduit.

Earth boring machines which have been previously known have tended to be either hand operated, thus lacking in power, or relatively heavy hydraulic units, which are difficult to transport to a site and burdensome to manipulate and align in situ. In a similar manner many previously known units have tended to be somewhat large, intricate in design and difficult to handle and manipulate in confined quarters. Still further, many previously known machines have been somewhat unstable in operation and permit unacceptable bore hole deviation.

Additionally, some have devised rotary and/or water injection systems. These devices have proven to be relatively complex and in some instances have been deemed unacceptable for use by local ordinances and/or regulations.

The difficulties suggested in the preceeding are not intended to be exhaustive, but rather are among many which may tend to reduce the effectiveness and operator satisfaction with prior earth boring equipment. Other noteworthy problems may also exist; however, those presented above should be sufficient to demonstrate that earth boring machines appearing in the past will admit to worthwhile improvement.

OBJECTS OF THE INVENTION

It is therefore a general object of the invention to provide a novel earth boring machine which will obviate or minimize difficulties of the type previously described.

It is a specific object of the invention to provide a novel, hydraulic earth boring machine which is compact and easily handled within a trench.

It is a related object of the invention to provide a novel, hydraulic earth boring machine wherein a hydraulic drive cylinder may be compactly mounted against a forward vertical wall of an earth trench during a boring operation.

It is a further object of the invention to provide a hydraulic earth boring machine wherein a boring shaft may be extended axially through a hydraulic cylinder without contacting hydraulic fluid within the system.

It is yet a further object of the invention to provide a hydraulic earth boring machine wherein a boring shaft may be quickly and firmly selectively engaged by a drive member and coaxially aligned with an intended line of travel.

It is yet still a further object of the invention to provide a hydraulic earth boring machine wherein positive gripping of a boring shaft will be achieved even during intermittent operation.

It is another object of the invention to provide a hydraulic earth boring machine wherein elevation and vertical aiming of the machine may be facilely achieved.

It is yet another object of the invention to provide a hydraulic earth boring machine wherein axial mounting and horizontal angling of the machine within a working trench is facilitated.

It is a related object of the invention to provide a hydraulic earth boring machine wherein vertical and horizontal alignment is stabilized and earth boring along a true line will be facilitated.

It is yet still a further object of the invention to provide a novel hydraulic earth boring machine which is highly rugged and reliable in operation.

THE DRAWINGS

Other objects and advantages of the invention will become apparent from the following detailed description of preferred embodiments thereof taken in conjunction with the accompanying drawings, wherein.

Figures 1, 5:
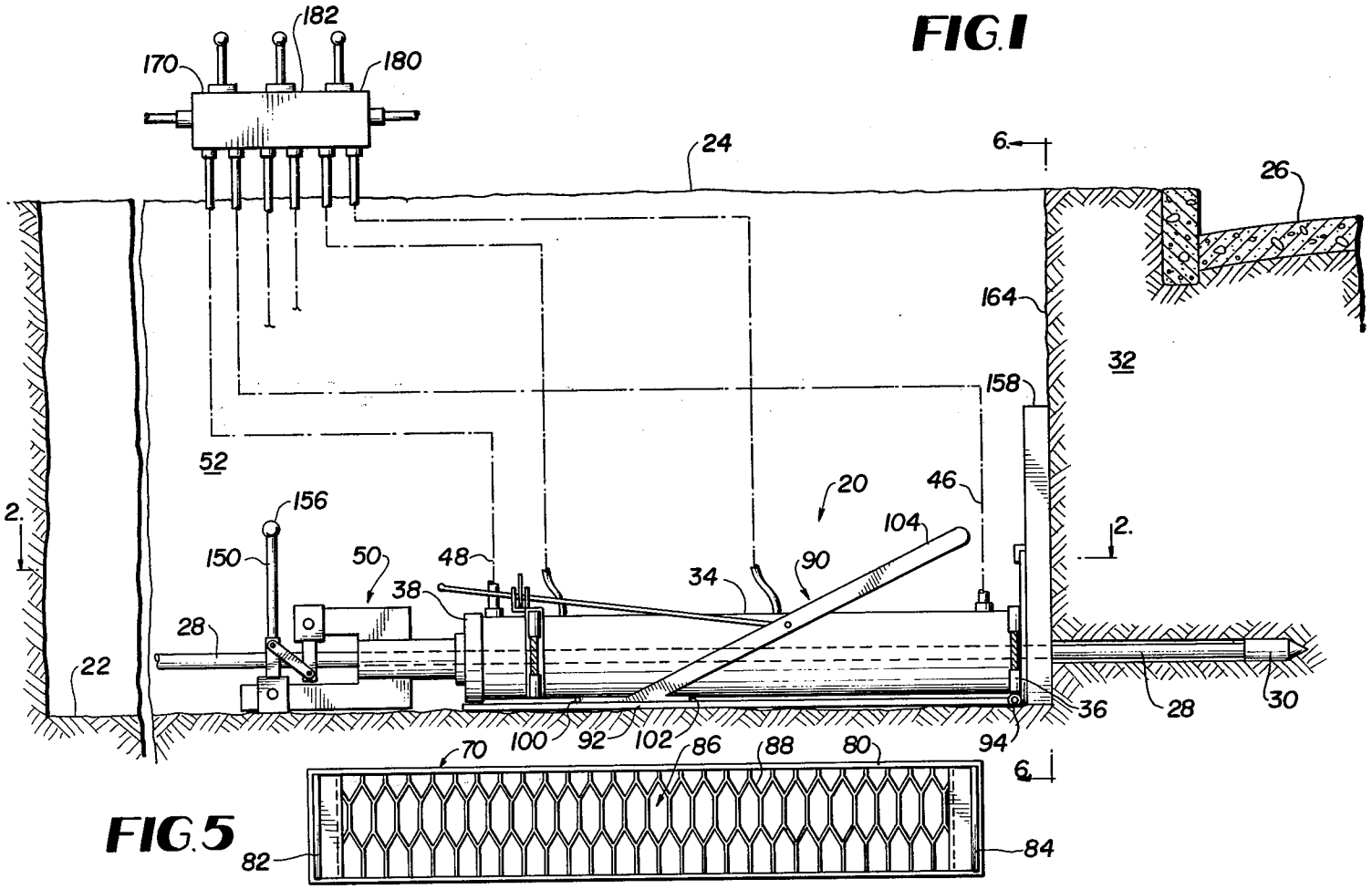
FIG. 1 is a side elevational view of a hydraulic earth boring machine, in situ, in accordance with a preferred embodiment of the invention.
Figure 2:
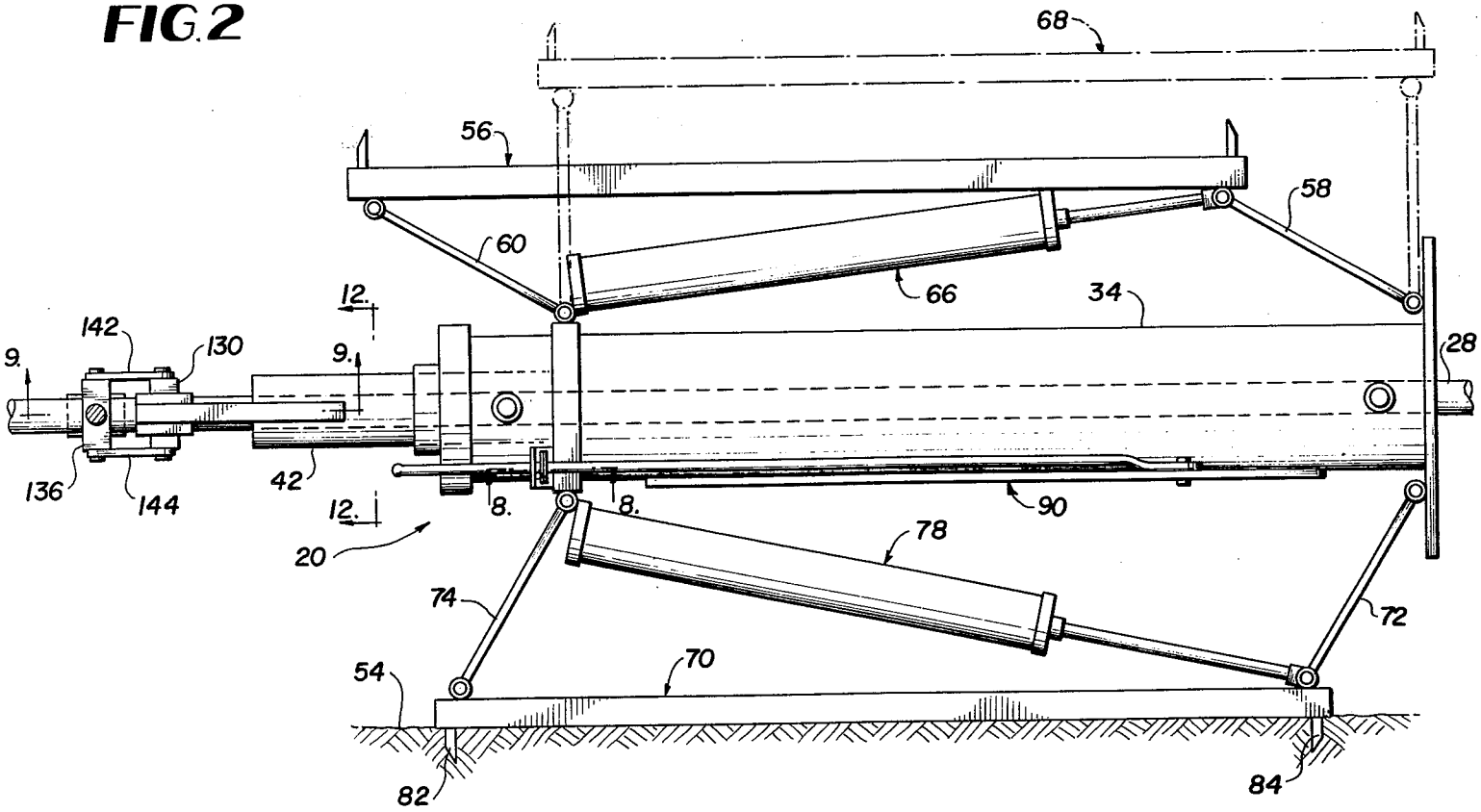
FIG. 2 is a plan view of the invention taken along section line 2—2 in FIG. 1.
Figure 7:
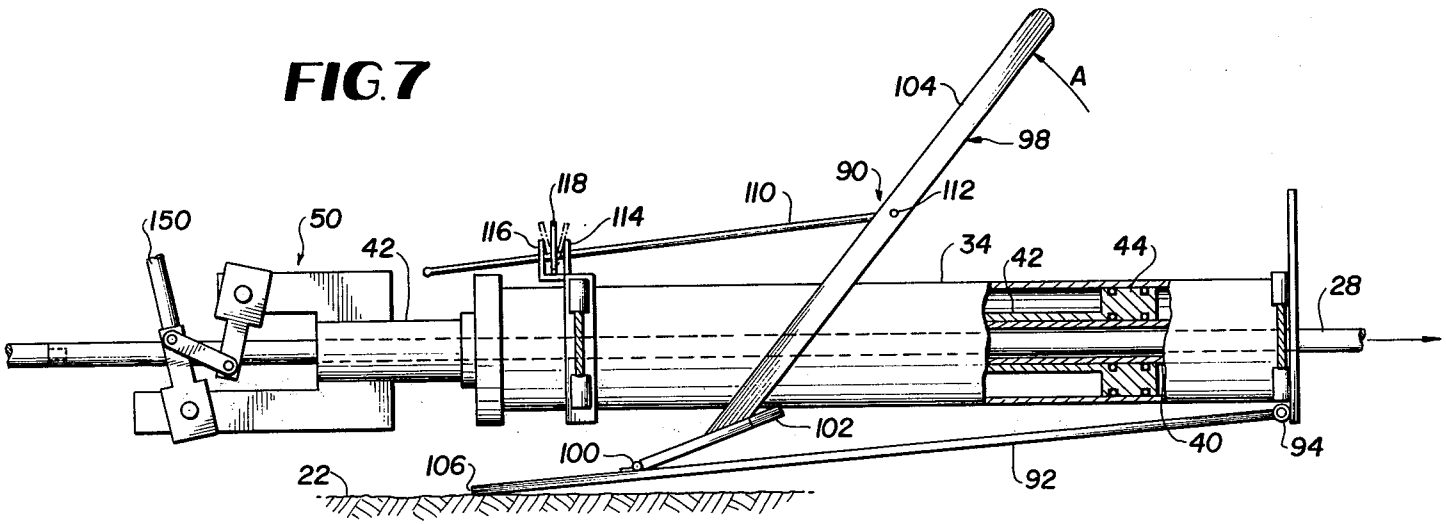
Figure 14:
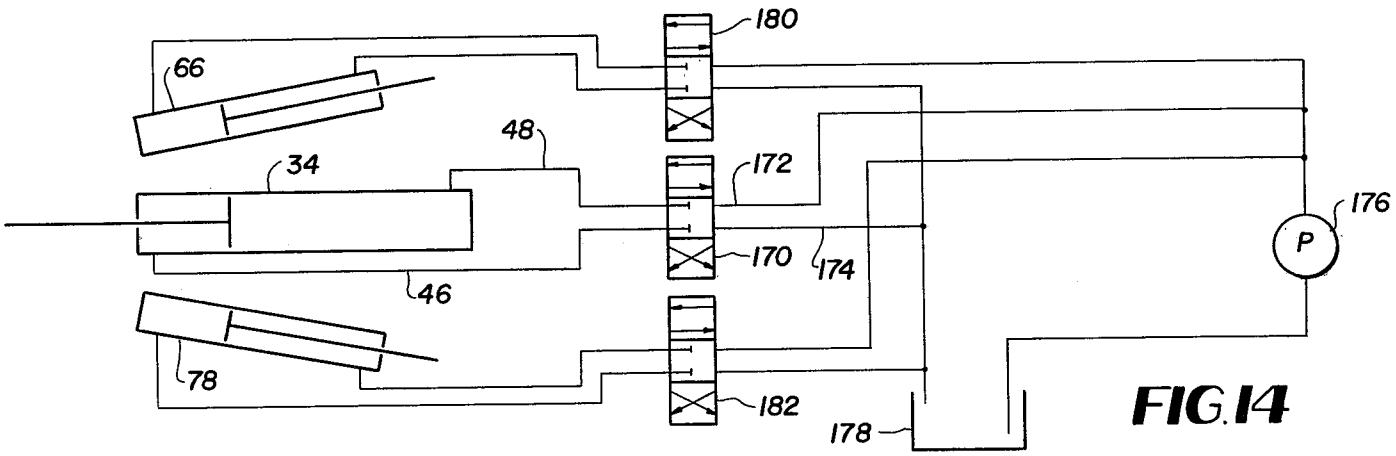
Figures 15, 16:
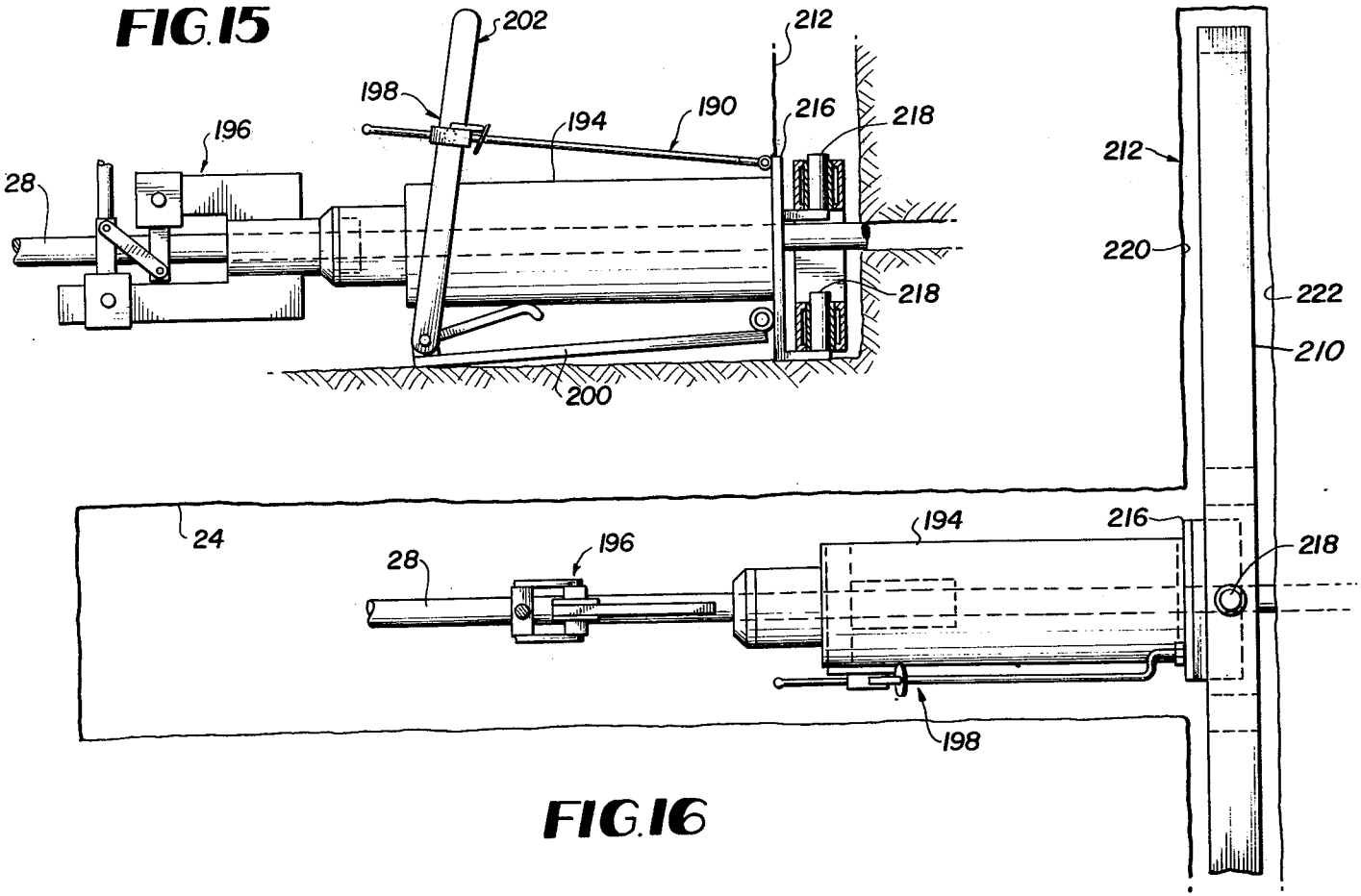

FIG. 3, note sheet 4, is a partial side view, in section, of a hydraulic push/pull cylinder for driving a boring shaft;

FIG. 4, note sheet 5, is a cross-sectional view taken along section lines 4—4 in FIG. 3 and discloses the concentric relationship of cylindrical members forming the hydraulic push/pull cylinder;

FIG. 5, note sheet 1, is a side view of an axial bracing gate in accordance with a preferred embodiment of the invention;

FIG. 6, note sheet 5, is a front view of the earth boring machine, in situ, as taken along section line 6—6 in FIG. 1, wherein the main hydraulic push/pull cylinder is shown laterally anchored to the side walls of a preformed earth trench;

FIG. 7, note sheet 3, is a partial side view of the boring machine which specifically discloses actuation of a leveling mechanism and boring shaft gripping assembly;

FIG. 8, note sheet 5, is a detailed side view of an elevation locking mechanism taken along section line 8—8 in FIG. 2;

FIG. 9, note sheet 4, is a cross-sectional view of the boring shaft gripping assembly in a neutral position as taken along section line 9—9 in FIG. 2;

FIG. 10 is a cross-sectional view similar to FIG. 9 with the gripping assembly actuated to effect left to right pulling action of the boring shaft relative to the hydraulic cylinder and pushing action of the boring shaft through an earth formation;

FIG. 11 is a cross-sectional end view taken along section line 11—11 in FIG. 9;

FIG. 12 is a cross-sectional view taken along section line 12—12 in FIG. 2 and discloses the boring shaft coaxially positioned within a drive cylinder;

FIG. 13 is a partial side view, in situ, and discloses bracing of the push/pull cylinder against a head rail during a pulling operation of the boring shaft relative to the hydraulic cylinder;

FIG. 14, note sheet 3, is a schematic diagram which discloses a hydraulic circuit for operating the earth boring machine;

FIG. 15, note sheet 6, discloses a side elevational view of an alternate preferred embodiment of the invention wherein axial mounting of the push/pull cylinder is provided by a forward earth trench and head rail; and FIG. 16 is a plan view of the embodiment of the invention depicted in FIG. 15.

DETAILED DESCRIPTION

Referring now to the drawings and particularly to FIG. 1 thereof, there will be seen a hydraulic earth boring machine 20 operable to form a passageway through an earth formation beneath an established surface. In this regard, the boring machine 20 is shown in a posture resting upon the bottom or bed 22 of a longitudinally extending earth trench 24. This trench has been dug generally adjacent and perpendicular to an established surface such as a roadway 26 or the like. The boring machine 20 is operable to push a boring shaft 28 carrying a penetrating cone 30 through a generally plastic earth formation 31 beneath the established roadway surface.

Once an initial passageway is established, an enlarged head 32 may be fitted onto the shaft 28 in place of the piercing head 30. The enlarging head may be pulled back through the earth formation to increase the size of the initial bore and form a conduit passageway, briefly note FIG. 13.

Returning now to FIGS. 1-4, the hydraulic earth boring machine 20 comprises a hydraulic push/pull cylinder 34 having a forward end plate 36 and a trailing end plate 38. Internally, note particularly FIGS. 3, 4, and 7, a cylindrical carrying sleeve 40 is mounted upon the forward end plate 36 and coaxially extends through the hydraulic cylinder 34 to the trailing end plate 38. This carrying sleeve slidingly receives the boring shaft 28, which is typically a solid, steel rod composed of discrete lengths threaded end-to-end together, note FIG. 9. A drive cylinder member 42 is coaxially mounted about the carrying sleeve 40 and is connected at an inner end directly to an annular piston head 44. The other end of drive cylinder 42 projects through the trailing end plate 38 and carries a gripping assembly 50 for releasably coupling the boring shaft 28 to the drive shaft 42.

A first hydraulic fluid line 46 is tapped into the front end of the cylinder 34 and a second hydraulic fluid line 48 is tapped into a trailing end of the cylinder. As hydraulic fluid is pumped into the cylinder through line 46, the annular piston 44 is driven from right to left as viewed in FIG. 3, and the drive cylinder member 42 is telescoped outwardly from end plate 38. When fluid is delivered to the hydraulic cylinder via line 48, the annular piston 44 is driven from left to right and the drive cylinder is retracted into the hydraulic cylinder 34.

The foregoing structural arrangement advantageously permits the boring shaft 28 to pass axially through the hydraulic cylinder without coming in contact with the hydraulic fluid. Moreover, the only member which projects forward of the end plate 36 is the boring shaft 28. Accordingly, the hydraulic cylinder 34 may be initially positioned directly against an earth bank to be penetrated.

Referring now specifically to FIGS. 2-6, there will be seen assemblies for axially bracing the hydraulic cylinder 34, in situ, between left 52 and right 54 earth side walls of the trench 24. More specifically, a first lateral gate 56 for engaging the lateral wall 52 is connected to a lateral surface of the hydraulic cylinder 34 by a forward 58 and rear 60 connecting link. Each of the links are pivotally mounted at the ends thereof between the lateral gate 56 and hydraulic cylinder 34. This pivotal mounting assembly creates a parallelogram assembly wherein the gate 56 and one side of the hydraulic cylinder 34 forms the long legs of the parallelogram and the connecting links 58 and 60 form the short legs.

In order to effect relative lateral movement of the gate 56 with respect to the hydraulic cylinder 34, a piston and cylinder assembly 66 is mounted between opposing obtuse corners of the parallelogram. The piston and cylinder assembly 66 is operable to selectively receive hydraulic fluid at either end thereof and thus extend, note the phantom representation 68 in FIG. 2, or retract the lateral gate 56.

In a similar manner, a second lateral gate 70 is mounted upon the other side of hydraulic cylinder 34 by forward and rear pivotal links 72 and 74 respectively. The right parallelogram axial brace is actuated by a hyraulic piston and cylinder assembly 78 extending between the obtuse corners of the linkage arrangement. Extending actuation of the piston and cylinder assembly 78 serves to drive the gate 70 into firm abutting contact with the lateral wall surface 54 of the earth trench 24.

The rearwardly inclined posture of the parallelogram assemblies will translate increased axial loading of the hydraulic cylinder 34 into increased transverse wedging of the unit between the trench walls thus insuring a stable mounting arrangement. Further, a degree of horizontal angling may be achieved by the parallelogram units. In this regard, actuation of only one side of the brace members will serve to angle the machine and push a forward end of the opposing gate further into the lateral face of the trench.

Referring specifically to FIG. 5, there will be seen a side elevational view of the lateral gate 70. The gate comprises a generally rectangular frame 80 having earth engaging projections or penetrating strips 82 and 84 mounted along the short sides thereof. The gate 70 has a generally open interior which is filled with a mesh work 86 of inter-connected strips 88 which operably abut against and grippingly engage with a lateral surface 54 of the earth trench 24.

Turning now specifically to FIGS. 1, 2, 7 and 8, there will be seen an elevating and vertical aiming assembly 90 in accordance with the invention. A generally rectangular base member 92 is pivotally mounted at a forward end to the hydraulic cylinder 34 at 94. The elevating base plate 92 generally extends along the axial length of the hydraulic cylinder 34 and operably underlies the cylinder. A bell crank lever 98 is pivotally mounted, as at 100, generally at the free end of the base plate 92 and a short arm 102 of the bell crank 98 serves to extend beneath and engage a lower surface of the hydraulic cylinder 34. A long arm 104 of the bell crank 98 extends generally upwardly and functions as a lifting hand lever.

By comparing FIGS. 1 and 7, the cylinder elevating and aiming technique of the subject invention will be readily appreciated. In this connected, as the hand lever 104 is pivoted about point 100 in the general direction of arrow A, note FIG. 7, the outermost end of the short lever arm 102 bears against the bottom of hydraulic cylinder 34 and the outermost end 106 of the base plate 92 bears against the bottom 22 of the earth trench. The resulting effect is a raising of the hydraulic cylinder 34 within the trench 24. In the elevated position, the cylinder may be canted about the fulcrum 106 to a desired vertical inclination.

When the desired elevation of the hydraulic cylinder 34 is achieved, it is preferable to be able to lock the bell crank 90 in position. In this connection, a rod 110 is pivotally mounted as at 112 to an intermediate portion of the long arm 104. A free end of the rod 110 extends through a first 114 and second 116 guide member and a pivotally mounted locking member 118, having an aperture 120 slightly larger than the diameter of the rod 110, note particularly FIGS. 7 and 8.

When it is desired to lock the bell crank 90 in a given position, the locking member 118 is tilted to the right in the direction of arrow B whereby outer peripheral edge surfaces of the aperature 120 securely engaged the rod 110 and axial movement of the rod in the direction of arrow C is prevented. This locking member serves to quickly and effectively lock the elevation of the hydraulic cylinder 34.

As previously noted, in an elevated posture the forward end of the cylinder may be vertically aimed before the boring shaft 28 is driven into the earth bank. When it is desired to lower the cylinder, the locking member 118 is pivoted to a generally vertical posture and the rod 110 is then free to translate relative to the locking mechanism back to a position depicted in FIG. 1.

Referring now to FIGS. 9–12, there will be seen detailed views of a gripping assembly 50 for drivingly coupling the boring shaft 28 to the drive cylinder 42. In this connection, the assembly 50 includes an upper arm member 126 connected to an upper surface of an outer extension of drive cylinder 42. The upper arm 126 projects generally longitudinally away from the free end of the drive cylinder 42 and parallel with an intended line of travel of the boring shaft 28. A lower arm 128 is connected to a lower portion of the drive shaft 46 and longitudinally projects in a posture parallel with the upper arm 120 and with the intended line of travel of the boring shaft 28.

The upper arm 126 is shorter than the lower arm 128 and serves to carry a first locking plate 130 which is pivotally mounted at one end 132 to the upper arm. The first locking plate 130 extends downwardly from the upper arm pivot 132 and is provided with an aperture 134 having an internal diameter slightly greater than the external diameter of boring shaft 28. In a similar manner, a second locking plate 136 is pivotally mounted to the lower arm 128 as at 138 and extends upwardly therefrom. The second locking plate is provided with an aperture 140 which, similar to aperture 134, has an internal diameter slightly greater than the external diameter of shaft 28. The apertures 134 and 140 in the first and second locking plates 130 and 136 respectively have an identical internal diameter and when the locking members are in a vertical posture the axis of the apertures are coaxial with that of the boring shaft 28.

As noted above, the aperture 134 and 140 have a diameter slightly greater than the diameter of boring shaft 28, note FIG. 11. Accordingly, when the locking plates 130 and 136 are in a vertical posture, as depicted in FIG. 9, the locking plates are free to translate relative to the boring shaft 28. If the locking plates are canted or inclined, however, as shown in FIG. 10, upper and lower edges of locking plate aperture 134 and lower and upper edges of locking plate aperture 140 grip the boring shaft 28. The peripheral edges of the apertures are rounded or chamfered in order to facilitate this gripping action without damaging the surface of the shaft 28.

A first link 142 is pivotally connected to a lower portion of the first locking plate 130 and an upper portion of the second locking plate 136 such that tilting of either the first or second locking plates will simultaneously tilt the other to an equal degree. Accordingly, there will be simultaneous clamping action of the bore shaft 28. In a similar manner, a second link 144 is mounted upon the other side of the first and second locking plates and acts in unison with link 142 (note particularly FIGS. 2 and 8).

Tilting of the locking plates is effected by actuation of a control arm 150 connected to the free end of locking plate 136, note FIG. 10. Once engagement of the apertures with the boring shaft is achieved, movement of the drive cylinder 42 and arms 126 and 128 serves to induce a tighter gripping action and the bore shaft is thus quickly and effectively coupled to the annular hydraulic piston 44 for driving action.

In the posture depicted in FIGS. 7 and 10, the shaft 28 may be operably pulled from left to right by the arms 126 and 128. This action will serve to push the drive shaft 28 and bore head 30 through an earth formation 30 as illustrated in FIG. 1. When it is desired to pull the boring shaft 28 back through the initial bore to enlarge a passageway, note FIG. 13, the control lever 150 is canted forward, the hydraulic pressure is reversed upon annular piston head 44 and the drive shaft 42 and arms 126 and 128 push outwardly from the hydraulic cylinder 34 to pull the bore shaft 28 back through the bore hole.

The foregoing actuation of the control lever 150 is advantageously enhanced by the provision of an inertial mass 156 mounted at the outer end of lever 150. This mass serves to keep the locking plates in engagement during pauses and temporary reversing action of the hydraulic cylinder.

Turning to FIGS. 6 and 13, a generally rectangular head rail 158 is shown fitted to a forward end of the hydraulic cylinder. The head rail 158 functions as a reaction member during a pulling of the boring shaft back through a bore to enlarge the bore with the expanded head member 32. At the same time a cable 162 may be attached to the head member to drag a conduit into the enlarged passageway. In any case the head rail 158 provides a stable axial reaction member when abutted against the forward trench wall 164 for such a pulling operation.

A hydraulic system suitable for operating the earth boring machine is depicted in FIGS. 1 and 14. As previously noted, hydraulic lines 46 and 48 are tapped into the opposite ends of cylinder 34. These lines travel to a four way valve 170 connected to a supply line 172 and a return 174. A pump 176 draws hydraulic fluid from a sump 178 for input to the supply line 172 and the return line 174 delivers fluid back to the sump 178 in a conventional closed circuit.

The pump 176 also delivers pressurized hydraulic fluid to four way valves 180 and 182 which are fluidically connected to the opposite ends of side brace hydraulic cylinders 66 and 78, respectively, for aligning and bracing the boring machine as previously discussed.

FIGS. 15 and 16 depict an alternate preferred earth boring machine 190 in accordance with the invention. Many of the major elements of this embodiment are identical to or similar to corresponding elements in the embodiment depicted in FIGS. 1–14. More specifically, the boring machine 190 includes a push/pull hydraulic cylinder 194 identical to cylinder 34. A gripping assembly 196 is identical to gripping assembly 50. An elevation assembly 198 includes a base plate 200 and bell crank 202 similar to elevating assembly 90. Accordingly a detailed description of the structure and function of the foregoing identical and/or similar assemblies may be had by reference to the prior description of these corresponding assemblies.

The most notable distinction between the two embodiments is the assembly for axially bracing and horizontally aligning the earth boring machine. In this regard, the first embodiment featured dual parallelogram brace assemblies and a head rail. The subject embodiment of the invention 190 does not include such assemblies but rather is provided with a transversely extending head brace 210 which is operably fitted into an earth trench 212 dug to an equal depth and normal to the main trench 24.

The head brace 210 is generally rectangular in construction and is preferably fashioned with a generally open frame having interconnecting struts. A head plate 216 is mounted across the forward end of hydraulic cylinder 194 and carries a pair of upwardly projecting mounting pins 218. The head brace 210 is mounted upon the pins and thus is carried by the forward end of the hydraulic cylinder 194.

Upon installation of the head brace 210 and hydraulic cylinder 194 within the trenches 212 and 24, the unit is horizontally pivoted about pins 218 to align the machine. During a bore shaft pushing operation from left to right, the head brace 210 abuts against the back wall 200 of the crossing trench 212. During a pulling operation, the head brace abuts against the forward wall of the earth trench 222.

BRIEF SUMMARY OF MAJOR ADVANTAGES OF THE INVENTION

After reading and understanding the foregoing description of preferred embodiments of the invention, in conjunction with the drawings, it will be appreciated that several distinct advantages of the subject hydraulic earth boring machine are obtained.

Without attempting to set forth all of the desirable features of the instant invention, as specifically and inherently disclosed above, at least some of the major advantages include a reliable and facilely operated gripping assembly 50 which serves to couple a hydraulic drive cylinder to an earth boring shaft. In this regard, a pair of locking plates are connected by a link and act in unison to releasably grip the boring shaft. This simultaneous gripping action serves to securely engage and coaxially align the boring shaft for delivery through the hydraulic drive cylinder. Moreover, an inertial mass at the outer end of the control lever advantageously maintains a desired position of the locking plates even turning temporary interruptions in machine operation.

The combination of a carrying sleeve, drive cylinder and annular piston head enables a boring shaft to be threaded coaxially through the hydraulic cylinder without contaminating the hydraulic operating fluid. Moreover in the subject system, only the boring shaft projects outwardly from the hydraulic working cylinder. Accordingly, the working cylinder may be closely abutted against a forward earth wall.

The bell crank elevating and locking assembly enables an operator to facilely raise and vertically align the hydraulic cylinder within an earth trench.

The parallelogram axial bracing assemblies of one embodiment of the invention quickly and stably secure the unit between the sides of a working trench. Axial loading of the hydraulic push/pull cylinder merely serves to increase the locking engagement of the side gates with the trench walls. During a pulling operation, the hydraulic cylinder construction allows the unit to be mounted on a head rail which abuts against a foward wall of the trench.

In an alternative embodiment, a "T" head rail is pivotally mounted onto the hydraulic cylinder and the unit advantageously mounts within a "T" shaped trench for both pushing and pulling boring operation.

In describing the invention, reference has been made to preferred embodiments and illustrative advantages of the invention. Those skilled in the art, however, and familiar with the instant disclosure of the subject invention may recognize additions, deletions, modifications, substitutions and/or other changes which will fall within the purview of the subject invention and claims.

What is claimed is:

1. A hydraulic earth boring machine for forming passageways through an earth formation beneath an established surface such as a roadway, walkway or the like, said earth boring machine comprising:

hydraulic cylinder means having a first end plate and a second end plate and a hydraulic fluid conduit operably tapped into each end of said hydraulic cylinder means;

drive cylinder means coaxially mounted within said hydraulic cylinder means and slidingly received through at least one of said end plates, said drive cylinder means having a central coaxial passage from end to end thereof for operably receiving a boring shaft extending coaxially through said hydraulic cylinder means;

an annular piston head mounted upon said drive cylinder means and slidingly received within the interior of said hydraulic cylinder means for axially translating said drive cylinder means relative to said hydraulic cylinder means upon pumping of hydraulic fluid into said hydraulic cylinder means;

means for elevating and vertically aiming said hydraulic cylinder means, in situ, within an earth trench;

means for axially bracing and horizontally angling said hydraulic cylinder, in situ, within the earth trench; and means connected to said drive cylinder means for selectively gripping a boring shaft to releasably couple said drive cylinder means to the boring shaft, said means for selectively gripping comprising, arm means connected to one end to said drive cylinder means and extending generally longitudinally along the path of the boring shaft, said arm means comprising, an upper arm connected to an upper portion of said drive cylinder means and extending generally longitudinally away from said drive cylinder means and parallel with an intended line of travel of the boring shaft, and a lower arm connected to a lower portion of said drive cylinder means and extending generally longitudinally away from said drive cylinder means and parallel with said upper arm and the intended line of travel of the boring shaft;

locking means pivotally mounted upon said arm means and having at least one aperature therethrough with internal dimensions greater than the external dimensions of the boring shaft for coaxially receiving the boring shaft, said locking means comprising, a first locking plate, having an aperture therethrough for receiving the boring shaft, and being pivotally mounted upon and downwardly depending from said upper arm, and a second locking plate, having an aperture therethrough for receiving the boring shaft, and being pivotally mounted upon and upwardly extending from said lower arm, wherein the axes of the apertures of said first and second locking plates are coaxial when said first and second locking plates are vertical in orientation, and link means pivotally connected, at one end thereof, to a lower, outer portion of said first locking plate and pivotally connected, at the other end thereof, to an upper, outer portion of said second locking plate wherein said first and second locking plates will pivot in unison but in an opposite angular direction about the upper and lower arms respectively, wherein generally horizontal earth boring may be achieved beneath an established surface by placing the boring machine within an earth trench generally adjacent and normal to the established surface, elevating and bracing said hydraulic cylinder means within the earth trench, tilting said locking means to couple said drive shaft to the boring shaft and actuating said annular piston and drive shaft to push the boring shaft generally horizontally through the earth formation beneath the established surface.

2. A hydraulic earth boring machine as defined in claim 1 and further comprising:

control arm means projecting outwardly from said second locking plate for providing actuation of said first and second locking plates to an inclined posture for gripping the boring shaft.

3. A hydraulic earth boring machine as defined in claim 2 and further comprising:

an inertial mass mounted upon the upper end of said control arm means for facilitating gripping action of said locking plates about the boring shaft upon initial actuation of said locking plates.

4. A hydraulic earth boring machine as defined in claim 1 wherein said means for elevating and vertically aiming comprises:

base means for contacting the bed of the earth trench and being pivotally connected to one end to a forward portion of said hydraulic cylinder means; and bell crank means having a long arm and a short arm pivotally connected adjacent the other end of said base means, wherein the short arm lies beneath said hydraulic cylinder means and actuation of said long arm will pivot said short arm about said base means and elevate said hydraulic cylinder within the earth trench.

5. A hydraulic earth boring machine as defined in claim 4 and further comprising:

locking means connected to said long arm for holding a desired elevational setting of said bell crank means.

6. A hydraulic earth boring machine as defined in claim 1 wherein said means for axially bracing and horizontally angling comprises:

first gate means for engaging one lateral side wall of the earth trench;

first arm means pivotally connected at the ends thereof between a forward end of said first gate means and a forward portion of said hydraulic cylinder means;

second arm means pivotally connected at the ends thereof between a trailing end of said first gate means and a trailing end portion of said hydraulic cylinder means;

first hydraulic means operably connected between said first gate and said hydraulic cylinder means for pivoting said first gate means toward and away from said hydraulic cylinder means such that said first gate means operably engages with the one lateral side wall of the earth trench;

second gate means for engaging the other lateral side wall of the earth trench;

first arm means pivotally connected at the ends thereof between a forward end of said second gate means and a forward portion of said hydraulic cylinder means;

second arm means pivotally connected at the ends thereof between a trailing end of said second gate means and a trailing end portion of said hydraulic cylinder means; and second hydraulic means operably connected between said first gate means and said hydraulic cylinder means for pivoting said second gate means toward and away from said hydraulic cylinder means such that said second gate means operably engages with the other lateral side wall of the earth trench.

7. A hydraulic earth boring machine as defined in claim 6 wherein said first and second gate means each comprise:

a generally rectangular frame with earth engaging projections extending outwardly from said generally rectangular frame; and a generally open mesh work of interconnected strips connected to said generally rectangular frame for operably engaging a lateral side wall of an earth trench.

8. A hydraulic earth boring machine as defined in claim 6 wherein:

one side of said hydraulic cylinder means, said first gate means and said first and second arm means connecting said first gate means to said hydraulic cylinder means form a first rearwardly inclined parallelogram linkage systems; and the other side of said hydraulic cylinder means, said second gate means and first and second arm means connecting said second gate means to said hydraulic cylinder means form a second rearwardly inclined parallelogram linkage system on the other side of said hydraulic cylinder means, wherein lateral positioning and horizontal angling of said hydraulic cylinder within said trench may be facilely achieved.

9. A hydraulic earth boring machine as defined in claim 6 and further comprising:

head rail means operably mounted at a forward end of said hydraulic cylinder means for engaging a forward end of an earth trench and for providing a reaction surface when the boring shaft is being pulled relative to said hydraulic cylinder means through the earth beneath as established surface.

10. A hydraulic earth boring machine as defined in claim 1 wherein said means for axially bracing and horizontally angling comprises:

generally rectangular head rail means connected to an end of said hydraulic cylinder means in a posture generally perpendicular to a central longitudinal axis of said hydraulic cylinder means and being operable to be placed in another earth trench fashioned perpendicular across the earth trench for generally axially receiving said hydraulic cylinder means wherein axial forces generated by said hydraulic cylinder means during an earth boring operation will be reacted through said head rail means.

11. A hydraulic earth boring machine as defined in claim 10 wherein:

said head rail means being pivotally mounted at the forward end of said hydraulic cylinder means to facilitate horizontal angling of the machine within the earth trench.

12. A hydraulic earth boring machine for forming passageways through an earth formation beneath an established surface such as a roadway, walkway or the like, said earth boring machine comprising:

hydraulic cylinder means having a first end plate and a second end plate and a hydraulic fluid conduit operably tapped into each end of said hydraulic cylinder means;

drive cylinder means coaxially mounted within said hydraulic cylinder means and slidingly received through at least one of said end plates, said drive cylinder means having a central coaxial passage from end to end thereof for operably receiving a boring shaft extending coaxially through said hydraulic cylinder means;

an annular piston head mounted upon said drive cylinder means and slidingly received within the interior of said hydraulic cylinder means for axially translating said drive cylinder means relative to said hydraulic cylinder means upon pumping of hydraulic fluid into said hydraulic cylinder means;

a cylindrical carrying sleeve coaxially mounted upon the first end plate of said hydraulic cylinder means and extending through said hydraulic cylinder means to a position adjacent the second end plate, said carrying sleeve being operable to directly surround and receive the boring shaft through said hydraulic cylinder means, and said carrying sleeve coaxially carrying said drive cylinder upon the exterior surface thereof such that said drive cylinder may operably telescope relative to said carrying sleeve and said hydraulic cylinder means through the second end plate of said hydraulic cylinder means;

means for elevating and vertically aiming said hydraulic cylinder means, in situ, within an earth trench;

means for axially bracing and horizontally angling said hydraulic cylinder, in situ, within the earth trench and means connected to said drive cylinder means for selectively gripping a boring shaft to releasably couple said drive cylinder means to the boring shaft, said means for selectively gripping comprising, an upper arm connected to an upper portion of said drive cylinder and extending generally longitudinally away from said one end of said drive cylinder means and parallel with an intended line of travel of the boring shaft, a lower arm connected to a lower portion of said drive cylinder means and extending generally longitudinally away from said drive cylinder means and parallel with said upper arm and the intended line of travel of the boring shaft, a first locking plate, having an aperture there through for receiving the boring shaft, and being pivotally mounted upon and downwardly depending from said upper arm, and a second locking plate, having an aperture there through for receiving the boring shaft, and being pivotally mounted upon and upwardly extending from said lower arm, wherein the axes of the apertures of said first and second locking plates are coaxial when said first and second locking plates are vertical in orientation, said lower arm being longer than said upper arm and said first locking plate being longitudinally offset toward said hydraulic cylinder means with respect to said second locking plate, and link means pivotally connected, at one end thereof, to said first locking plate and pivotally connected, at the other end thereof, to said second locking plate wherein said first and second locking plates will pivot in unison, but in an opposite angular direction, about the upper and lower arm respectively;

wherein generally horizontal earth boring may be achieved beneath an established surface by placing the boring machine within an earth trench generally adjacent and normal to an established surface, elevating and bracing said hydraulic cylinder means within the earth trench, tilting said locking means to couple said drive shaft to the boring shaft and actuating said annular piston and drive shaft to push the boring shaft generally horizontally through the earth formation beneath the established surface.

13. A hydraulic earth boring machine as defined in claim 12 and further comprising:

control arm means projecting outwardly from said second locking plate for providing actuation of said first and second locking plates to an inclined posture for gripping the boring shaft; and an inertial mass mounted upon the upper end of said control arm means for facilitating gripping action of said locking plates about the boring shaft upon initial actuation of said locking plates.

14. A hydraulic earth boring machine as defined in claim 12 wherein said means for axially bracing and horizontally angling comprises:

first gate means for engaging one lateral side wall of the earth trench, said first gate means including, a generally rectangular frame with earth engaging projections extending outwardly therefrom:

first arm means pivotally connected at the ends thereof between a forward end of said first gate and a forward portion of said hydraulic cylinder means;

second arm means pivotally connected at the ends thereof between a trailing end of said first gate and a trailing end portion of said hydraulic cylinder means;

first hydraulic means operably connected between said first gate and said hydraulic cylinder means for pivoting said first gate toward and away from said hydraulic cylinder means such that said first gate operably engages with the one lateral side wall of the earth trench;

second gate means for engaging the other lateral side wall of the earth trench, said second gate means including, a generally rectangular frame with earth engaging projections extending outwardly therefrom;

first arm means pivotally connected at the ends thereof between a forward end of said first gate and a forward portion of said hydraulic cylinder means;

second arm means pivotally connected at the ends thereof between a trailing end of said second gate and a trailing end portion of said hydraulic cylinder means; and second hydraulic means operably connected between said first gate and said hydraulic cylinder means for pivoting said second gate toward and away from said hydraulic cylinder means such that said second gate operably engages with the other lateral side wall of the earth trench.

15. A hydraulic earth boring machine as defined in claim 14 and further comprising:

head rail means operably mounted at a forward end of said hydraulic cylinder means for engaging a forward end of an earth trench and for providing a reaction surface when the boring shaft is being pulled relative to said hydraulic cylinder means through the earth beneath an established surface.

16. A hydraulic earth boring machine as defined in claim 12 wherein said means for axially bracing and horizontally angling comprises:

generally rectangular head rail means pivotally connected to the forward end of said hydraulic cylinder means in a posture generally perpendicular to a central longitudinal axis of said hydraulic cylinder means and being operable to be placed in another earth trench fashioned perpendicular across the earth trench for generally axially receiving said hydraulic cylinder means wherein axial forces generated by said hydraulic cylinder means during an earth boring operation will be reacted through said head rail means.

17. A hydraulic earth boring machine for forming passageways through an earth formation beneath an established surface such as a roadway, walkway or the like, said earth boring machine comprising:

hydraulic cylinder means having end plates and a hydraulic fluid conduit operably tapped into each end of said hydraulic cylinder means;

drive cylinder means coaxially mounted within said hydraulic cylinder means and slidingly received through at least one of said end plates, said drive cylinder means having a central coaxial passage from end to end thereof for operably receiving a boring shaft extending coaxially through said hydraulic cylinder means;

an annular piston head mounted upon said drive cylinder means and slidingly received within the interior of said hydraulic cylinder means for axially translating said drive cylinder means relative to said hydraulic cylinder means upon pumping of hydraulic fluid into said hydraulic cylinder means;

means for elevating and vertically aiming said hydraulic cylinder means, in situ, within an earth trench, said means for elevating and vertically aiming including, base means for contacting the bed of the earth trench and being pivotally connected at one end to said hydraulic cylinder means; and bell crank means having a long arm and a short arm, said bell crank means being pivotally connected to said base means, wherein the short arm lies beneath said hydraulic cylinder means and actuation of said long arm will pivot said short arm about said base means and elevate said hydraulic cylinder within the earth trench;

means for axially bracing and horizontally angling said hydraulic cylinder, in situ, within the earth trench, said means for axially bracing and horizontally angling including, generally rectangular head rail means connected to an end of said hydraulic cylinder means in a posture generally perpendicular to a central longitudinal axis of said hydraulic cylinder means and being operable to be placed in another earth trench fashioned perpendicular across the earth trench for generally axially receiving said hydraulic cylinder means wherein axial forces generated by said hydraulic cylinder means during an earth boring operation will be reacted through said head rail means;

means connected to said drive cylinder means for selectively gripping a boring shaft to releasably couple said drive cylinder means to the boring shaft, said means for selectively gripping comprising, arm means connected at one end to said drive cylinder means and extending generally longitudinally along the path of the boring shaft, and locking means pivotally mounted generally at the other end of said arm means and having an aperture therethrough with internal dimensions greater than the external dimensions of the boring shaft for coaxially receiving the boring shaft, said locking means including a locking plate, having an aperture therethrough for receiving the boring shaft, and being pivotally mounted upon said arm means and extending in the path of the boring shaft such that said aperture is normally coaxially aligned with the boring shaft, and control arm means operably connected to said locking plate to provide for manual actuation of said locking plate to incline said locking plate for gripping the boring shaft with peripheral upper and lower segments of the aperture through said locking plate and to facilitate continuous gripping action of said locking plate about the boring shaft;

wherein generally horizontal earth boring may be achieved beneath an established surface by placing the boring machine within an earth trench generally adjacent and normal to the general direction of the established surface, elevating and bracing said hydraulic cylinder means within the earth trench, tilting said locking means to couple said drive shaft to the boring shaft and actuating said annular piston and drive shaft to push the boring shaft generally horizontally through the earth formation beneath the established surface.

18. A hydraulic earth boring machine as defined in claim 17 wherein:

said head rail means being pivotally mounted at the forward end of said hydraulic cylinder means to facilitate horizontal angling of the machine within the earth trench.

19. A hydraulic earth boring machine as defined in claim 18 and further comprising:

locking means connected to said long arm for holding a desired elevational setting of said bell crank means.

20. A hydraulic earth boring machine for forming passageways through an earth formation beneath an established surface such as a roadway, walkway or the like, said earth boring machine comprising:

hydraulic cylinder means having end plates and a hydraulic fluid conduit operably tapped into each end of said hydraulic cylinder means;

drive cylinder means coaxially mounted within said hydraulic cylinder means and slidingly received through at least one of said end plates, said drive cylinder means having a central coaxial passage from end to end thereof for operably receiving a boring shaft extending coaxially through said hydraulic cylinder means;

an annular piston head mounted upon said drive cylinder means and slidingly received within the interior of said hydraulic cylinder means for axially translating said drive cylinder means relative to said hydraulic cylinder means upon pumping of hydraulic fluid into said hydraulic cylinder means;

means for elevating and vertically aiming said hydraulic cylinder means, in situ, within an earth trench, said means for elevating and vertically aiming including, base means for contacting the bed of the earth trench and being pivotally connected at one end to said hydraulic cylinder means; and bell crank means having a long arm and a short arm, said bell crank means being pivotally connected to said base means, wherein the short arm lies beneath said hydraulic cylinder means and actuation of said long arm will pivot said short arm about said base means and elevate said hyraulic cylinder within the earth trench;

means for axially bracing and horizontally angling said hydraulic cylinder, in situ, within the earth trench, said means for axially bracing and horizontally angling comprising, first gate means for engaging one lateral side wall of the earth trench, first arm means pivotally connected at the ends thereof between a forward end of said first gate means and a forward portion of said hydraulic cylinder means;

second arm means pivotally connected at the ends thereof between a trailing end of said first gate means and a trailing end portion of said hydraulic cylinder means;

first hydraulic means operably connected between said first gate and said hydraulic cylinder means for pivoting said first gate means toward and away from said hydraulic cylinder means such that said first gate means operably engages with the one lateral side wall of the earth trench, second gate means for engaging the other lateral side wall of the earth trench, first arm means pivotally connected at the ends thereof between a forward end of said second gate means and a forward portion of said hydraulic cylinder means, second arm means pivotally connected at the ends thereof between a trailing end of said second gate means and a trailing end portion of said hydraulic cylinder means, second hydraulic means operably connected between said first gate means and said hydraulic cylinder means for pivoting said second gate means toward and away from said hydraulic cylinder means such that said second gate means operably engages with the other lateral side wall of the earth trench, one side of said hydraulic cylinder means, said first gate means and said first and second arm means connecting said first gate to said hydraulic cylinder form a first rearwardly inclined parallelogram linkage system, and the other side of said hydraulic cylinder means, said second gate means and first and second arm means connecting said second gate to said hydraulic cylinder means form a second rearwardly inclined parallelogram linkage system on the other side of said hydraulic cylinder means, wherein lateral positioning and horizontal angling of said hydraulic cylinder within said trench may be facilely achieved;

means connected to said drive cylinder means for selectively gripping a boring shaft to releasably couple said drive cylinder means to the boring shaft, said means for selectively gripping comprising, arm means connected at one end to said drive cylinder means and extending generally longitudinally along the path of the boring shaft, and locking means pivotally mounted generally at the other end of said arm means and having an aperture therethrough with internal dimensions greater than the external dimensions of the boring shaft for coaxially receiving the boring shaft, said locking means including a locking plate, having an aperture therethrough for receiving the boring shaft, and being pivotally mounted upon said arm means and extending in the path of the boring shaft such that said aperture is normally coaxially aligned with the boring shaft, and control arm means operably connected to said locking plate to provide for manual actuation of said locking plate to incline said locking plate for gripping the boring shaft with peripheral upper and lower segments of the aperture through said locking plate and to facilitate continuous gripping action of said locking plate about the boring shaft;

wherein generally horizontal earth boring may be achieved beneath an established surface by placing the boring machine within an earth trench generally adjacent and normal to the general direction of the established surface, elevating and bracing said hydraulic cylinder means within the earth trench, tilting said locking means to couple said drive shaft to the boring shaft and actuating said annular piston and drive shaft to push the boring shaft generally horizontally through the earth formation beneath the established surface.

21. A hydraulic earth boring machine as defined in claim 20 and further comprising:

head rail means operably mounted at a forward end of said hydraulic cylinder means for engaging a forward end of an earth trench and for providing a reaction surface when the boring shaft is being pulled relative to said hydraulic cylinder means through the earth beneath an established surface.

22. A hydraulic earth boring machine as defined in claim 20 wherein said first and second gate means each comprise:

a generally rectangular frame with earth engaging projections extending outwardly from said generally rectangular frame; and a generally open mesh work of interconnected strips connected to said generally rectangular frame for operably engaging a lateral side wall of an earth trench.

* * * * *